United States Patent [19]

Lerebourg

[11] 4,287,144

[45] Sep. 1, 1981

[54] METHOD OF MANUFACTURING CEMENTITIOUS ARTICLES AND VARIOUS FORMS OF EQUIPMENT OF PUTTING THIS METHOD INTO PRACTICE

[75] Inventor: Michel Lerebourg, Marseille en Beauvaisis, France

[73] Assignee: Etablissements DEMLER S.A., Crevecoeur Le Grand (Oise), France

[21] Appl. No.: 88,095

[22] Filed: Oct. 24, 1979

[30] Foreign Application Priority Data

Oct. 24, 1978 [FR] France ..... 78 30240

[51] Int. Cl.[3] ..... B28B 11/00

[52] U.S. Cl. ..... 264/79; 264/297; 264/333; 264/DIG. 43

[58] Field of Search ..... 264/79, 82, 333, 297, 264/DIG. 43, DIG. 57; 425/452

[56] References Cited

U.S. PATENT DOCUMENTS

| | | | |
|---|---|---|---|
| 1,463,841 | 8/1923 | Richman | 264/DIG. 57 |
| 2,170,936 | 8/1939 | Baron | 264/82 |
| 3,904,723 | 9/1975 | Prince | 264/79 X |

*Primary Examiner*—Thomas P. Pavelko

*Attorney, Agent, or Firm*—Brown, Flick & Peckham

[57] ABSTRACT

This invention concerns a method of manufacturing cementitious articles such as parpens, in which the articles are moulded, preferably by compression, on a base plate serving for handling the articles for the drying operations, especially steam drying.

2 Claims, 5 Drawing Figures

METHOD OF MANUFACTURING CEMENTITIOUS ARTICLES AND VARIOUS FORMS OF EQUIPMENT OF PUTTING THIS METHOD INTO PRACTICE

The present invention relates to a method of manufacturing cementitious articles, such as parpens, in which method the articles are moulded, more especially by compression, on a base-plate serving for the handling of the articles for the drying operations, especially steam-drying.

There is already known a manufacturing method of the above type as well as various forms of equipment for putting this method into practice.

In more detail, according to the known method, equipment for the manufacture of concrete articles consists of a press which receives a mix of moulding material. This material is poured into a mould just placed in position on a base-plate. The material to be moulded is then vibrated and pressed into the mould. Thereafter the machine raises the pressing ram and the mould up again. The moulded articles remain on the base-plate and are thus carried away and handled. At the outlet from the press, the articles are transferred into steam driers to speed up the setting of the cement. The means used for the movement between the press and the steam drier, then from the steam drier to the place where the articles are stock piled, are extremely complex. Indeed the equipment includes both a raising device and a lowering device. The raising device is located in the line of manufacture at the outlet from the press. The raising device receives one by one the base-plates leaving the press. The raising device, just as the lowering device, is constituted by two parallel series of brackets each carried by an endless chain. Each set of two brackets is intended to receive one base-plate. After receiving a plate, the brackets are raised through one step or interval appropriate to the placement in the receiving portion of following brackets which receive the following base-plate which again is elevated through one step, etc. When the raising device has received a certain number of base-plates in this way, for example one dozen, a truck with a multiplicity of forks, corresponding to the number of levels of the raising device, takes these plates in order to place them into the steam drier.

The steam drier is made up by stone-faced boxes, open at their forward parts. These stone-faced boxes, which are of a width corresponding to a base-plate and a depth of several base-plates, include slide-bars also stone faced, on which the truck with a multiplicity of forks sets down its stack of separate base-plates supporting the articles. Once the box of the steam drier is filled, the entry thereto is closed by means of a tarpaulin, in order to avoid losses of heat. As the reaction of hardening of the cement is an exothermic reaction, the heat given out and which remains in the box favours the rapid setting of the articles.

After a delay of several hours in the steam drier a lift truck with a multiplicity of forks, similar to that which loaded the steam drier (the same truck may be involved) takes the "stacks" of base-plates from the steam drier to place them into a lowering device. The construction of the lowering device is identical to that of the raising device, but its operation is the reverse. The lowering device receives the base-plates of the pile on the multiplicity of brackets. The removal of the base-plates is accomplished by starting with the lower base-plate.

Once the latter has been taken out, the lowering device descends through one step, in order to place the second base-plate in the extraction position, starting from the bottom etc. until all the base-plates have been taken from the lowering device. The operation then starts up again. The base-plates loaded with hardened articles are taken towards the unloading stage. At this stage, the hardened articles, which may now be handled without the intermediary of the base-plates, are removed from the plates in order to be stockpiled. The base plates are cleaned and are brought back to the press.

From one use to the other, the base-plates are turned over in order to avoid any buckling of the base-plates in a way which would, at one and the same time, make handling thereof awkward and adversely affect the regularity of the articles manufactured in the equipment.

Such equipment is expensive to carry into effect and awkward to operate. Indeed the raising and lowering devices and the lift trucks with a multiplicity of forks are fittings which are technically complex and because of this are relatively fragile. Moreover it must be possible for such equipment to be used by non-qualified personnel and this necessitates many technical precautions in order to avoid difficulties in operation. That complicates all the more the construction thereof and consequently the cost. Now, the corollary of this complexity is the relative fragility of the fitting equipment.

Operational difficulties are frequent and costly not only because of the interferences necessitated thereby on the faulty machine but because they give rise to the danger of bringing the entire manufacturing equipment to a halt.

Lastly, the construction of the steam drier is relatively expensive as masonary work is involved.

Generally the make-up of the equipment is likewise expensive because of a considerable amount of basic work involved.

The trucks with a multiplicity of forks serving the raising and lowering devices are complex constructions which must be positioned in a precise manner in relation to the raising and lowering devices and to the steam drier. To this end it is necessary to have the trucks rolling on rails. That increases the expense of the substructure.

Finally the known equipments for manufacturing cementitious articles are complex, necessitate very expensive substructures, and lack flexibility.

Indeed it is particularly expensive to move such manufacturing equipment as the very heavy substructures cannot be moved and they must be constructed on the new site where the equipment is to be used.

Now, because of economic necessities equipment for manufacturing cementitious articles, such as parpens, must be very close to the place where these articles are to be used.

The object of the present invention is to provide a method of and means for enabling the manufacture of cementitious articles by moulding, pressing and rapid drying, while reducing to a minimum the cost of the substructure, so that the result is equipment which at the same time is more flexible in use, can be moved, and which can also be manufactured in one country and exported to other countries to be set up as desired.

To this end the invention comprises a method of manufacturing cementitious articles such as parpens, in which the articles are moulded, preferably by compression, on a base-plate serving for handling the articles for the drying operations, especially steam drying, the method being characterised in that a base-plate, or a plurality of juxtaposed base-plates, is covered over by a cover set in place after the moulding and the articles are left covered in this way during at least a part of the curing period.

The invention also relates to means for putting this method into practice, that is to equipment.

Thanks to the invention, the stone-faced steam driers, the forked trucks and the raising and lowering devices are not necessary. Now, as these various constructions and machines represent a considerable fraction of the total cost of the equipment, the elimination thereof enables a very considerable gain both in material and in substructures.

Now, these prior art substructures cannot be prefabricated but have to be constructed on the site of the equipment.

In contrast to that, the equipment according to the invention may be manufactured on a large industrial scale and all that is required on the site provided for the equipment is to construct a concrete surface receiving the press, the endless conveyors, etc. and which also constitutes the surface for stockpiling and drying the articles.

Indeed it is sufficient to provide a single surface on which a lift truck of the usual kind sets down the piles of base-plates laden with articles covered by the covers, the latter serving to support the base-plates. These covers represent but a small investment in relation to the total cost of the equipment. These covers may be mass produced, for example by injection moulding from synthetic material. Because of this the whole equipment may be factory made to be sent along to its site; the cost of erection is also very small as the machines are simple and do not require a strict precision when being set up on site. This advantage is also to be found when modifications are effected on site as it is possible in practice without costs additional to those of transport to set up this equipment at a new site, for example closer to the place of use of the articles, etc.

The present invention will be described in more detail with reference to the accompanying drawings, in which.

Figure 3:
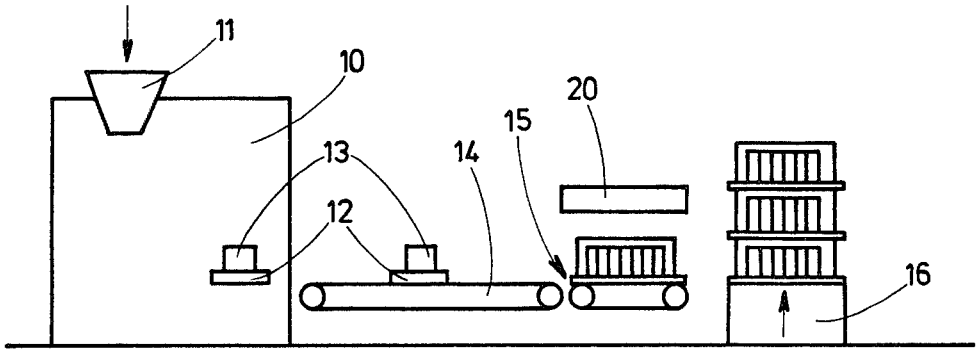
FIG. 3 is a diagrammatic view of equipment for carrying out the method according to the invention.
Figure 3A:
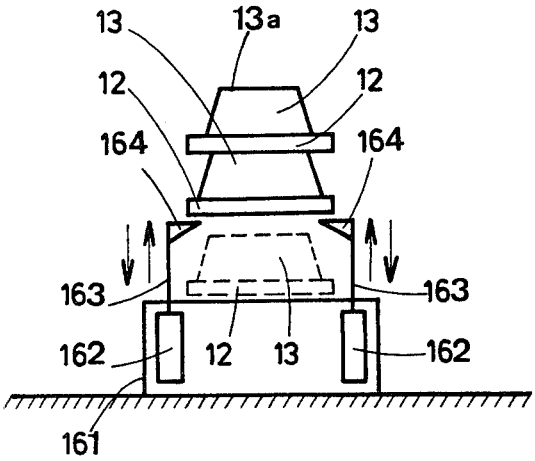

FIG. 3*a* is a diagram of an appliance for stacking base-plates; and

Figure 4:
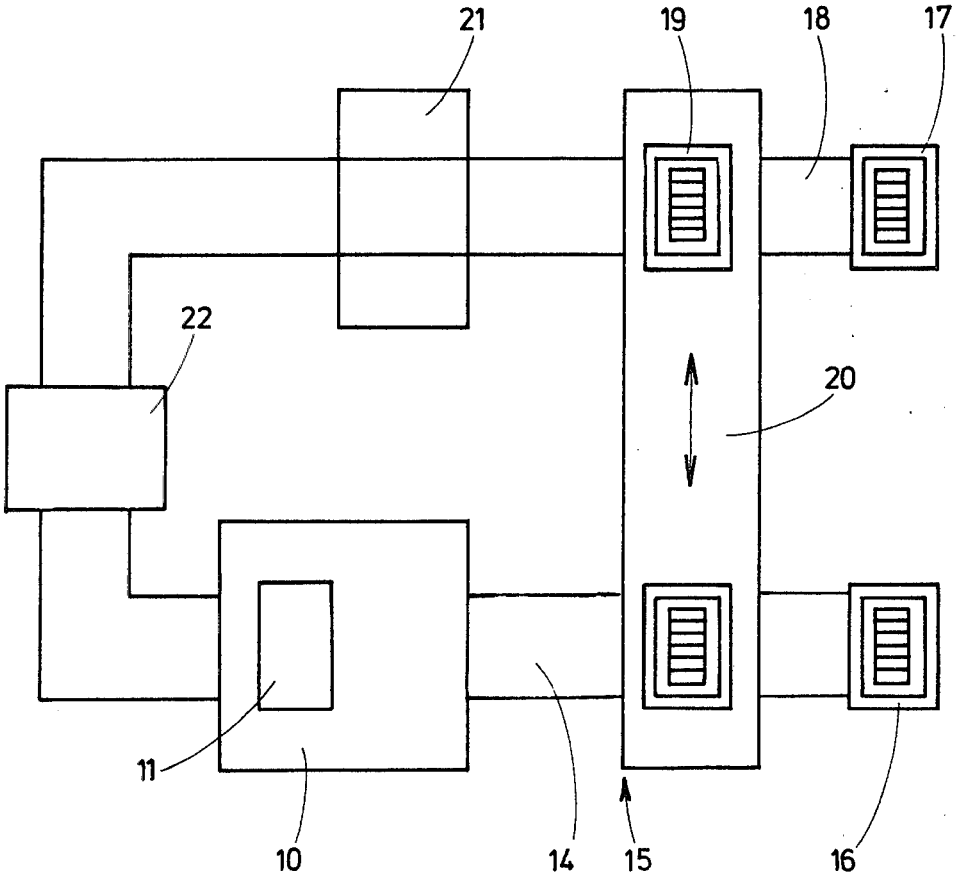

FIG. 4 is a plan view of equipment according to the invention.

Figure 1:
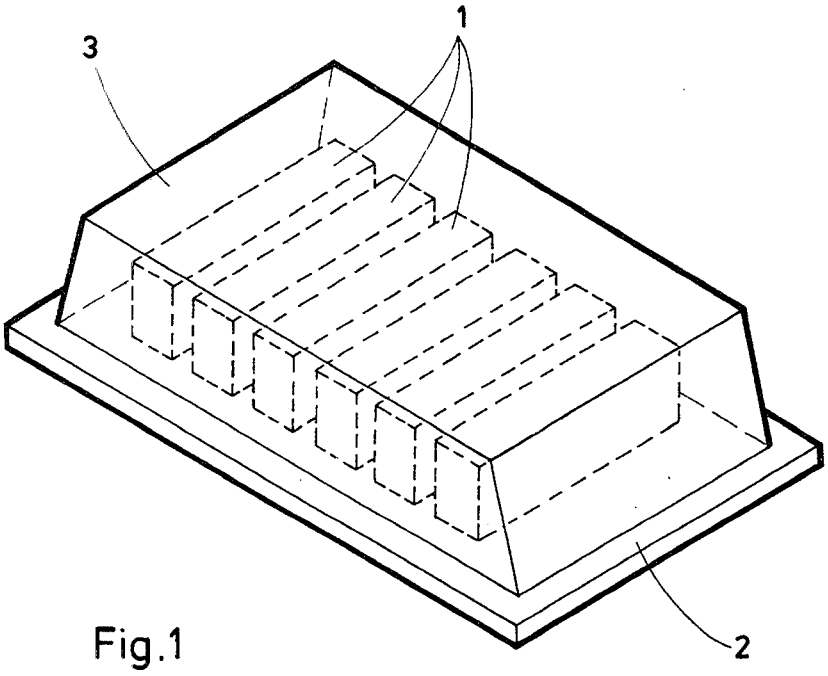
FIG. 1 is a perspective view of a base-plate loaded with moulded articles, covered by a cover.
Figure 2:
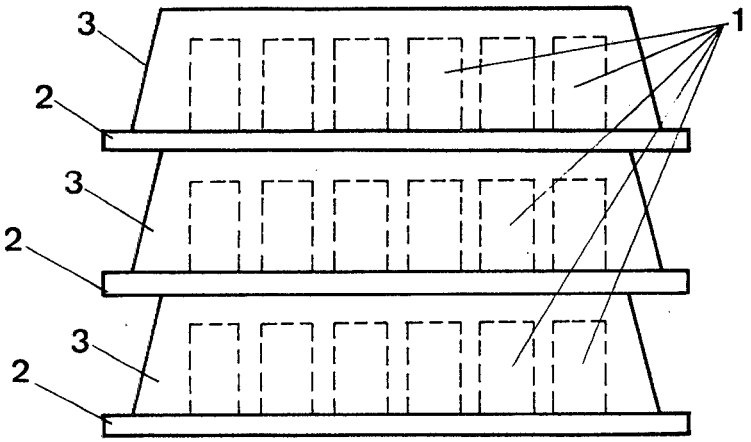
FIG. 2 is a diagrammatic view of a stack of base-plates according to the invention.

According to FIGS. 1 and 2, the invention relates to a method of manufacturing cementitious products, for example products used in the building industry, this method consisting in moulding articles 1 on a base-plate 2 and in covering the articles by a cover 3 forming at least a heat screen. This cover may possibly be to some extent porous and permit an exchange of air with the exterior.

The cover 3 not only retains the heat given out by the exothermic reaction of the setting of the cement of the prefabricated elements 1, but also permits the stacking of several base-plates 2 thus loaded, as is indicated in FIG. 2. The pieces of equipment, such as the raising and lowering devices or the trucks with multiple forks thereby become unnecessary. It is sufficient to provide an ordinary lift truck to take hold of the base-plates and this truck may then take up a stack of several base-plates, as in FIG. 2.

According to the kind of articles, their height etc. a stack may comprise a greater or lesser number of base-plates.

In order to avoid the occupation of too much space, the height of the cover is chosen as a function of the height of the articles. However, these two heights must not correspond exactly and the ideal height of the cover will depend on the volume of air to be enclosed, etc.

The base-plates 2 used to receive the articles during the pressing and the drying are preferably wooden plates. Although metalic plates could also be contemplated the cost thereof, much greater than that of the wooden plates, at present restricts the use thereof.

The covers 3 may be made in any material. Preferably, in order that a low manufacturing cost can be reached, it is advantageous to select covers made of injection-moulded synthetic material. This cover could be solid or hollow and include reinforcing and rigidifying ribs. The cover may also have some openings to facilitate or permit some exchange of air with the exterior, should the occasion arise.

FIGS. 3 and 4 show diagrammatically equipment for putting into practice the method described hereinbefore.

This equipment comprises a press 10 which receives the material to be moulded (concrete) through the loading funnel 11. The base-plates 12 are introduced into the machine and the articles 13 are moulded on these base-plates. An endless conveyor 14 then transfers the whole lot 12, 13 thus made up, on to a conveyor constituting a waiting stage 15. Downstream of the waiting stage 15 is the stacking appliance 16. This stacking appliance 16 is made up as is shown in FIG. 3*a* by a chassis 161 including jacks or other lifting means 162, the rods 163 of which are provided with retractable brackets 164. In order to stack the base-plates 12 laden with articles 13 covered with covers 13*a*, the lifting appliance 162 lifts the lower base-plate of the stack by means of the retractable brackets 164. The stack is thus lifted sufficiently in order to enable the putting into place of the last base-plate provided with the cover 13 (represented in dotted lines in FIG. 3*a*). Once this latter putting into place has been effected the jack rods 163 are lowered and they deposit the stack of base-plates on the cover 13 of the last base-plate put into place. After this movement, the brackets 164 are moved away, for example to the side, and are located below the last base-plate 12 put into place, in order to raise the stack thus increased by one assembly (base-plate/articles/cover).

As is shown in FIG. 4, the manufacturing line has the form of a U laid horizontally with a return.

On leaving the lifting appliance 16, the stack of laden base-plates is taken up by a lift truck to be placed at a stack piling site for the duration of curing. After curing the stack is taken up again in order to be transported to the appliance 17 similar to the appliance 16 and which serves to extract one by one the base-plates 12 furnished with covers 13*a*. This extraction is effected by lifting the last but one base-plate from the bottom of the stack so as to lift all the base-plates supported by this last base-plate provided with the cover and thus to release the lower base-plate. This lower base-plate is taken by an endless conveyor 18, and conveyed into the station 19; in this station 19 the cover is raised in order to be conveyed by the transverse conveyor 20 into the waiting station 15 and covers a base-plate leaving the press 10. On leaving the station 19, the base-plates carrying the moulded and cured articles are conveyed into the station 21 in which the articles are lifted from the base-plate. The base-plate continues on its way to be cleaned and returned into the station 22 in order to go back into the press 10.

The conveyor 20 preferably comprises a conveyor with vent holes which takes the cover of each base-plate into the station 19 in order to transfer same onto the homologous base-plate which is in the waiting station 15. This makes possible a fast rotation, both of the base-plates and of the covers.

It is also possible to incorporate a stock of covers between the take-up station 19 of the covers of the base-plates after curing and the station 15 where the covers are placed on the base-plates carrying the moulded articles leaving the press. This makes possible different speeds of operation between these two stations.

I claim:

1. A method of manufacturing cementitious articles such as parpens, in which the articles are moulded on a base-plate serving for handling the articles for the curing operation, the method comprising moulding the cementitious articles on a base-plate, placing a self-supporting cover on the plate with said articles under the cover to form a curing unit, successively forming like units in the same manner, placing each successive unit on top of the preceding unit to thereby form a stack of units for the curing operation, and maintaining said stack intact during at least part of the curing period.

2. A method according to claim 1, in which said stack is formed by moving said units in succession to a stacking station and raising each successive unit there to permit the following unit to be moved into position below it, and in which, after curing, each successive lowermost unit in the stack is removed while the remaining units above it are supported temporarily and then lowered, whereby the covers can be removed from the base plates.

* * * * *